US010321717B2

(12) United States Patent
Besso

(10) Patent No.: US 10,321,717 B2
(45) Date of Patent: Jun. 18, 2019

(54) AEROSOL-GENERATING ARTICLE COMPRISING A DETACHABLE FRESHENER DELIVERY ELEMENT WITH HIGH RESISTANCE TO DRAW

(71) Applicant: PHILIP MORRIS PRODUCTS S.A., Neuchatel (CH)

(72) Inventor: Clement Besso, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/564,843

(22) PCT Filed: Apr. 28, 2016

(86) PCT No.: PCT/EP2016/059495
§ 371 (c)(1),
(2) Date: Oct. 6, 2017

(87) PCT Pub. No.: WO2016/174141
PCT Pub. Date: Nov. 3, 2016

(65) Prior Publication Data

US 2018/0110257 A1 Apr. 26, 2018

(30) Foreign Application Priority Data

Apr. 30, 2015 (EP) ..... 15166046

(51) Int. Cl.
*A24F 47/00* (2006.01)
*A24D 1/00* (2006.01)
(Continued)

(52) U.S. Cl.
CPC ..... *A24F 47/008* (2013.01); *A24D 1/002* (2013.01); *A24D 1/008* (2013.01); *A24D 3/041* (2013.01);
(Continued)

(58) Field of Classification Search
CPC ..... A24F 47/008; A24D 3/048; A24D 3/061
See application file for complete search history.

(56) References Cited

U.S. PATENT DOCUMENTS 515,774 A 3/1894 Hotz
2,764,154 A 1/1953 Murai
(Continued)

FOREIGN PATENT DOCUMENTS

DE 1873551 U 6/1963
EP 0793420 3/2000
(Continued)

OTHER PUBLICATIONS

International Search Report and Written Opinion for PCT/EP2016/059495 dated Jul. 12, 2016 (10 pages).
(Continued)

*Primary Examiner* — James Harvey
(74) *Attorney, Agent, or Firm* — Mueting, Raasch & Gebhardt, P.A.

(57) ABSTRACT

There is provided an aerosol-generating article (10) comprising an aerosol-generating substrate (12) and a mouthpiece (14) secured to a downstream end of the aerosol-generating substrate (12). The mouth piece (14) comprises at least one segment of porous filter material (20) and a blocking segment (27) that impedes air flow downstream of the at least one segment of porous filter material (20). The blocking segment (27) comprises a segment of support material (22) having an annular shape defining a channel (24) extending through at least part of the segment of support material (22), and at least one freshener delivery element (26) contained within the channel (24). The blocking segment (27) comprising the at least one freshener delivery element (26) is detachable from the at least one
(Continued)

segment of porous filter material (20) to decrease the resistance to draw of the aerosol-generating article (10).

13 Claims, 3 Drawing Sheets

(51) Int. Cl.
*A24D 3/06* (2006.01)
*A24D 3/04* (2006.01)
*A24F 7/04* (2006.01)

(52) U.S. Cl.
CPC ..... *A24D 3/061* (2013.01); *A24F 7/04* (2013.01); *A24F 47/006* (2013.01)

(56) References Cited

U.S. PATENT DOCUMENTS

| | | | | |
|---|---|---|---|---|
| 2,893,399 | A | 7/1959 | Jacoby | |
| 4,138,477 | A | 2/1979 | Gaffar | |
| 4,238,475 | A | 12/1980 | Witzel | |
| 4,657,032 | A | 4/1987 | Dorr | |
| 5,059,416 | A | 10/1991 | Cherukuri | |
| 5,724,997 | A | 3/1998 | Smith | |
| 6,426,089 | B1 | 7/2002 | Sunohara | |
| 2005/0268926 | A1 | 12/2005 | Hsu et al. | |
| 2007/0095357 | A1 | 5/2007 | Besso | |
| 2008/0230079 | A1* | 9/2008 | Besso | A24D 3/048 131/274 |
| 2008/0302376 | A1 | 12/2008 | Karles | |
| 2014/0290678 | A1* | 10/2014 | Besso | A24D 3/04 131/337 |
| 2015/0272206 | A1* | 10/2015 | Besso | A24D 3/04 131/280 |
| 2017/0172211 | A1* | 6/2017 | Batista | A24F 47/008 |
| 2018/0110257 | A1* | 4/2018 | Besso | A24D 1/002 |
| 2018/0116277 | A1* | 5/2018 | Besso | A61K 8/347 |

FOREIGN PATENT DOCUMENTS

| | | |
|---|---|---|
| EP | 1336346 | 8/2003 |
| JP | 2008024696 | 2/2008 |
| JP | 5183104 | 1/2013 |
| WO | WO 98/07338 | 2/1998 |
| WO | WO 2010/115829 | 10/2010 |
| WO | WO 2013/178515 | 12/2013 |

OTHER PUBLICATIONS

Momints https://en.wikipedia.org/wiki/Momints, Dec. 21, 2017 (2 pages).
Leffingwell, John C., "Cooling Ingredients and Their Mechanism of Action", reprinted from Handbook of Cosmetic Science and Technology, 3rd ed., 2009, pp. 661-675.
Wisp, http://www.colgateopticwhite.com/toothbrushes/wisp, Dec. 21, 2017 (3 pages).
European Extended Search Report for Application No. 15166046.1 dated Nov. 16, 2015 (7 pages).

* cited by examiner

AEROSOL-GENERATING ARTICLE COMPRISING A DETACHABLE FRESHENER DELIVERY ELEMENT WITH HIGH RESISTANCE TO DRAW

This application is a U.S. National Stage Application of International Application No. PCT/EP2016/059495, filed Apr. 28, 2016, which was published in English on Nov. 3, 2016, as International Publication No. WO 2016/174141 AI. International Application No. PCT/EP2016/059495 claims priority to European Application No. 15166046.1 filed Apr. 30, 2015.

FIELD OF INVENTION

The present invention relates to an aerosol-generating article comprising a detachable freshener delivery element. The invention finds particular application as an elongate smoking article, such as a cigarette.

BACKGROUND

After smoking a smoking article, such as a cigarette, it is common for a consumer to utilise a post-smoking breath freshener. One example of a common breath freshener is a liquid breath freshener composition that carried in a container and sprayed into the consumer's mouth after smoking. Other known breath fresheners include chewable breath fresheners, such as mentholated sweets and chewing gum. However, some consumers may find it inconvenient to carry a separate breath freshener.

Alternative attempts at providing a freshening sensation to a consumer include the addition of menthol into the cigarette itself. However, delivering menthol via the mainstream smoke during smoking of the cigarette often provides an inadequate delivery of menthol to the consumer when compared with breath freshener products such as sprays and chewable breath fresheners that are inserted directly into the mouth.

Therefore, it would be desirable to provide a novel breath freshener for consumers of aerosol-generating articles that mitigates or overcomes the disadvantages of known breath freshener delivery systems.

SUMMARY

According to the present invention there is provided an aerosol-generating article comprising an aerosol-generating substrate and a mouthpiece secured to a downstream end of the aerosol-generating substrate. The mouthpiece comprises at least one segment of porous filter material and a blocking segment that impedes air flow downstream of the at least one segment of porous filter material. The blocking segment comprises a segment of support material having an annular shape defining a channel extending through at least part of the segment of support material between an upstream end of the segment of support material and a downstream end of the segment of support material, and at least one freshener delivery element contained within the channel extending through at least part of the segment of support material. The blocking segment comprising the at least one freshener delivery element is detachable from the at least one segment of porous filter material to decrease the resistance to draw of the aerosol-generating article.

As used herein, the terms "upstream" and "downstream" describe the relative positions of elements, or portions of elements, of the aerosol-generating article in relation to the direction in which a consumer draws on the aerosol-generating article during use thereof. Aerosol-generating articles as described herein comprise a downstream end (that is, the mouth end) and an opposed upstream end. In use, a consumer draws on the downstream end of the aerosol-generating article. The downstream end is downstream of the upstream end, which may also be described as the distal end.

As used herein, the term "aerosol-generating substrate" describes a substrate capable of releasing, upon heating, volatile compounds, which can form an aerosol. The aerosol generated from aerosol-generating substrates may be visible or invisible and may include vapours (for example, fine particles of substances, which are in a gaseous state, that are ordinarily liquid or solid at room temperature) as well as gases and liquid droplets of condensed vapours.

As used herein, the term "freshener delivery element" refers to an element of the aerosol-generating article which can be used to deliver a breath freshening experience to a consumer, separate from smoking the article. That is, the freshener delivery element is not used to flavour the smoke or other aerosol generated by the article during smoking.

By providing the freshener delivery element as an integral but detachable part of the aerosol-generating article, aerosol-generating articles in accordance with the present invention provide a convenient way for a consumer to carry the freshener delivery element. In particular, the present invention eliminates the need for a consumer to carry a separate freshener delivery element that might be used for post-smoking breath freshening, such as chewing gum.

Furthermore, providing the freshener delivery element as a detachable portion of the aerosol-generating article allows the user to remove the freshener delivery element from the aerosol-generating article prior to smoking, and subsequently administer the freshener directly into the mouth, typically after smoking. Therefore, aerosol-generating articles according to the present invention provide improved breath freshening when compared to known aerosol-generating articles in which a flavourant is delivered during smoking in the mainstream smoke.

The blocking segment comprising the freshener delivery element impedes air flow downstream of the at least one segment of porous filter material. The blocking segment comprising the freshener delivery element therefore provides a very high resistance to draw when the blocking segment is attached to the aerosol-generating article, which advantageously provides a reminder to the consumer that the freshener delivery element is still attached to the aerosol-generating article if the consumer attempts to smoke the aerosol-generating article without detaching the freshener delivery element. For example, the high resistance to draw provided by the blocking segment may be sufficiently high so that the consumer can draw little or no air through the aerosol-generating article when the blocking segment is attached, which may draw the consumer's attention to the need to detach the blocking segment. Additionally, or alternatively, in those embodiments in which the aerosol-generating substrate comprises a combustible substrate, such as tobacco, the high resistance to draw can make it more difficult to light the aerosol-generating article when the blocking segment remains attached, therefore further reminding the consumer to detach the blocking segment prior to smoking the aerosol-generating article.

Detaching the blocking segment comprising the freshener delivery element reduces the resistance to draw of the aerosol-generating article and therefore may allow the consumer to smoke the article in a manner similar to a typical aerosol-generating article, such as a conventional filter cigarette.

When the blocking segment comprising the freshener delivery element is attached to the at least one segment of porous filter material, preferably the aerosol-generating article has a resistance to draw of at least about 250 millimeters of water gauge (mmWG), more preferably at least about 300 mmWG, more preferably at least about 400 mmWG, more preferably at least about 500 mmWG, more preferably at least about 600 mmWG, more preferably at least about 750 mmWG, more preferably at least about 1000 mmWG. A resistance to draw of at least about 250 mmWG will typically be noticed by a consumer as unusually high and may therefore provide a reminder to the consumer to detach the blocking segment comprising the freshener delivery element. In those embodiments in which the aerosol-generating substrate comprises a combustible substrate, such as tobacco, a resistance to draw of at least about 500 mmWG may prevent sustained combustion of the substrate once lit, and may prevent lighting of the substrate altogether. Preferably, the resistance to draw of the aerosol-generating article tends to infinity when the blocking segment is attached to the at least one segment of porous filter material.

Additionally, or alternatively, the aerosol-generating article may have a resistance to draw similar to that of a conventional aerosol-generating article, after the blocking segment has been detached from the at least one segment of porous filter material. After the blocking segment has been detached from the at least one segment of porous filter material, preferably the aerosol-generating article has a resistance to draw of between about 40 mmWG and about 150 mmWG, more preferably between about 70 mmWG and about 120 mmWG, more preferably between about 80 mmWG and about 110 mmWG, most preferably between about 95 mmWG and about 105 mmWG.

As used herein, the term "resistance-to-draw" refers to the pressure required to force air through the full length of the object under test at the rate of 17.5 milliliters per second at 22 degrees Celsius and 101 kilopascals (760 Torr). Resistance to draw is expressed in units of millimeters water gauge (mmWG) and is measured in accordance with ISO 6565:2011.

As described above, the blocking segment of the mouthpieces of aerosol-generating articles according to the invention comprises an annular segment of support material in which the freshener delivery element is provided. The support material may be a porous material, such as a segment of porous filter material. Alternatively, the support material may be a non-porous material, such as low density polyethylene closed cell foam. The combination of the segment of support material and the freshener delivery element should provide a sufficient impediment to airflow to provide the desired high resistance to draw when the blocking segment is attached to the at least one segment of porous filter material.

The annular segment of support material defines a channel in which the at least one freshener delivery element is contained. The channel may be open at both ends so that the channel extends from the upstream end of the segment of support material to the downstream end of the segment of support material. Alternatively, the channel may be open only at one end of the segment of support material, so that the channel forms a pocket in which the freshener delivery element is provided. In those embodiments in which the channel comprises only one open end, the open end may be provided at the downstream end of the segment of support material so that the freshener delivery element is visible when the blocking segment is attached to the at least one segment of porous filter material, which may provide a visual reminder to the consumer of the need to detach the blocking segment. Alternatively, the open end of the channel may be provided at the upstream end of the segment of support material so that the freshener delivery element is only accessible after the blocking segment has been detached from the at least one segment of porous filter material, which may prevent the freshener delivery element being accidentally and prematurely dislodged from the segment of support material.

Providing a channel through at least part of a segment of support material and in which the freshener delivery element is provided facilitates the manufacture of the aerosol-generating article by permitting insertion of the freshener delivery element into the channel after the segment of support material and the freshener delivery element have been formed separately. In those embodiments in which the channel comprises an open end at the downstream end of the segment of support material, the freshener delivery element can be inserted into the channel in the segment of support material after the segment of support material has been combined with the at least one segment of porous filter material and the aerosol-generating substrate to form the remainder of the aerosol-generating article. In such embodiments, the blocking segment is formed when the freshener delivery element is inserted into the segment of support material.

Providing the freshener delivery element within a channel extending through at least part of a segment of support material also provides a convenient means for the consumer to extract the freshener delivery element from the segment of support material after smoking the aerosol-generating article, or to extract a freshener from the freshener delivery element. For example, in those embodiments in which the freshener delivery element comprises a breakable capsule containing a liquid or gel freshener, the consumer can squeeze the segment of support material to break the capsule and squeeze the freshener along the channel and out of the segment of support material. In such embodiments, the channel preferably comprises an open end at only one end of the segment of support material. Alternatively, the consumer can squeeze the segment of support material to squeeze the entire freshener delivery element along the channel and out of the segment of support material, which may be particularly convenient in those embodiments in which the freshener delivery element comprises a solid, chewable freshener delivery element, for example.

Each of the channel of the annular segment of support material and the freshener delivery element may have a substantially circular cross-sectional shape. In such embodiments, an internal diameter of the channel is preferably less than an external diameter of the freshener delivery element, which advantageously provides an interference fit between the segment of support material and the freshener delivery element to reduce the risk of the freshener delivery element becoming accidentally dislodged from the segment of support material.

In any of the embodiments described above, the aerosol-generating article may further comprise a wrapper circumscribing the mouthpiece and a portion of the downstream end of the aerosol-generating substrate, the wrapper comprising a line of weakness extending around the wrapper so that the blocking segment comprising the freshener delivery element is detachable from the at least one segment of porous filter material by breaking the wrapper along the line of weakness. For example, to detach the blocking segment a consumer may twist the blocking segment relative to the at least one segment of porous filter material to tear the wrapper along the line of weakness.

The line of weakness is preferably a line of perforations extending around the wrapper, preferably a line of micro laser perforations. Preferably, the perforations are spaced at between 10 and 20 perforations per centimeter, more preferably about 15 perforations per centimeter. Typically, the wrapper is pre-perforated prior to being wrapped around the segment of non-porous material and the at least one segment of porous filter material.

In some embodiments, the line of weakness overlies an upstream edge of the blocking segment. That is, when the blocking segment is detached from the aerosol-generating article, the upstream edge of the removed portion of the wrapper is aligned with the upstream edge of the blocking segment in the longitudinal direction.

The term "longitudinal direction" is used herein to refer to the direction extending between the upstream and downstream ends of the aerosol-generating article. Where the aerosol-generating article has a substantially cylindrical shape, the axis of the cylinder extends in the longitudinal direction. The "transverse direction" extends perpendicular to the longitudinal direction, and the "circumferential direction" extends around the longitudinal direction.

In those embodiments in which the line of weakness overlies an upstream edge of the blocking segment, an upstream end of the blocking segment may abut a downstream end of the at least one segment of porous filter material. In such embodiments, when the blocking segment is detached, the downstream edge of the remaining wrapper is aligned with the downstream edge of the at least one segment of porous filter material at the mouth end of the aerosol-generating article.

Alternatively, the upstream end of the blocking segment may be spaced apart from the downstream end of the at least one segment of porous filter material so that, when the blocking segment is detached, the downstream edge of the remaining wrapper is positioned downstream of the downstream edge of the at least one filter segment. That is, the remaining portion of the wrapper upstream of the line of weakness extends downstream of a downstream edge of the at least one segment of porous filter material so that the portion of the wrapper upstream of the line of weakness defines a mouth end recess when the blocking segment has been detached.

In a further alternative, the line of weakness may overlie the blocking segment downstream of an upstream edge of the blocking segment. In such embodiments, when the blocking segment is detached, the remaining portion of the wrapper upstream of the line of weakness extends downstream of a downstream edge of the at least one segment of porous filter material so that the portion of the wrapper upstream of the line of weakness defines a mouth end recess when the segment of non-porous material has been detached.

In those embodiments in which the remaining wrapper forms a mouth end recess after the blocking segment has been detached, the wrapper is preferably a tipping paper having a basis weight of between about 65 grams per square meter and about 85 grams per square meter, more preferably between about 70 grams per square meter and about 80 grams per square meter. Additionally, or alternatively, the thickness of the tipping paper may be between about 90 micrometers and about 120 micrometers.

Alternatively, in those embodiments in which the tipping paper is not required to form a mouth end recess after the blocking segment has been detached from the at least one segment of porous filter material, the tipping paper may have a basis weight of between about 10 grams per square meter and about 100 grams per square meter, more preferably between about 20 grams per square meter and about 80 grams per square meter. The tipping paper may have a basis weight of between about 30 grams per square meter and about 60 grams per square meter, or between about 20 grams per square meter and about 40 grams per square meter. The tipping paper may have a basis weight of about 25 grams per square meter.

In any of the embodiments described above, the aerosol-generating article may further comprise at least one indicia provided on an outer surface of the aerosol-generating article, the at least one indicia providing a further reminder to the consumer of the need to detach the blocking segment from the aerosol-generating article prior to smoking. The indicia may be printed or otherwise provided on the outer surface of the aerosol-generating article. The at least one indicia may comprise at least one of text and one or more graphics. For example, in those embodiments in which the aerosol-generating article comprises a wrapper having a line of weakness, the at least one indicia may comprise a text based message instructing the consumer to tear the wrapper along the line of weakness. Additionally, or alternatively, the at least one indicia may comprise a graphic indicating the location of the line of weakness. In such embodiments, the indicia is preferably provided on the wrapper and adjacent the line of weakness.

In any of the embodiments described above, the at least one freshener delivery element may comprise at least one solid freshener delivery element. For example, the freshener delivery element may comprise at least one of a dissolvable or chewable tablet, or chewing gum. Examples of methods and formulations for forming chewing gum are described in U.S. Pat. No. 4,238,475-A and U.S. Pat. No. 5,059,416-A. U.S. Pat. No. 4,138,477-A describes formulations for forming lozenges, pressed candy and tablets each containing a breath freshening formulation.

Additionally, or alternatively, the freshener delivery element may comprise at least one breakable capsule containing a gel or liquid freshener. Examples of breath freshening products containing a liquid or gel breath freshening composition are described in JP-5183104-B2 and EP-0793420-B1.

In any of the embodiments described above, the freshener delivery element may comprise at least one flavourant comprising at least one of menthol, linalool, thymol, eucalyptol, methyl salicylate, and combinations thereof. Additionally, or alternatively, the at least one flavourant may comprise at least one of lemon oil, peppermint oil, parsley oil, champignon essence, green tea extract, oolong tea extract, mugwort drawing-extract, apple extract, kaki-fruit extract, ginger essence, and combinations thereof. Suitable flavourants are described in U.S. Pat. No. 6,426,089-B1.

The at least one flavourant may comprise a diluent. The diluent may comprise at least one of palm oil and a medium-chain triglyceride.

Many naturally occurring flavourants can be obtained either by extraction from a natural source or by chemical synthesis if the structure of the compound is known. The flavourants can be extracted from a part of a plant or an animal by physical means, by enzymes, or by water or an organic solvent, and thus include any extractive, essence, hydrolysate, distillate, or absolute thereof. Plants that can be used to provide flavourants include, but are not limited to, those belonging to the families, Lamiaceae (for example, mints), Apiaceae (for example, anise, fennel), Lauraceae (for example, laurels, cinnamon, rosewood), Rutaceae (for example, citrus fruits), Myrtaceae (for example, anise myrtle), and Fabaceae (for example, liquorice). Non-limiting examples of sources of flavourants include mints such as peppermint and spearmint, coffee, tea, cinnamon, clove, ginger, cocoa, vanilla, chocolate, *eucalyptus, geranium, agave*, juniper, lemon balm, basil, cinnamon, lemon basil, chive, coriander, lavender, sage, tea, thyme and caraway. The term "mints" is used to refer to plants of the genus *Mentha*. Suitable types of mint leaf may be taken from plant varieties including but not limited to *Mentha piperita, Mentha arvensis, Mentha niliaca, Mentha citrata, Mentha spicata, Mentha spicata crispa, Mentha cordifolia, Mentha longifolia, Mentha pulegium, Mentha suaveolens*, and *Mentha suaveolens variegata*.

The freshener delivery element may provide one or more sensory effects other than a flavour sensation, such as a cooling or a warming sensation, a tingling sensation, a numbing sensation, effervescence, increased salivation, and combinations thereof. These sensory effects may be provided by one or more flavourants, including the flavourants listed above. Additionally, or alternatively, the freshener delivery element may comprise at least one non-flavourant material which provides one or more of these sensory effects without providing a flavour sensation. For example, suitable compounds that produce a cooling effect and can be used as an active material include, but are not limited to, the family of carboxamide compounds, such as the Wilkinson-Sword (WS) compounds WS-3 (N-Ethyl-p-menthane-3-carboxamide), WS-23 (2-Isopropyl-N,2,3-trimethylbutyramide), WS-5 [Ethyl 3-(p-menthane-3-carboxamido)acetate], WS-27 (N-Ethyl-2,2-diisopropylbutanamide), WS-14 [N-([ethoxycarbonyl]methyl)-p-menthane-3-carboxamide], and WS-116 (N-(1,1-Dimethyl-2-hydroxyethyl)-2,2-diethylbutanamide).

Aerosol-generating articles according to the present invention may be filter cigarettes or other aerosol-generating articles in which the aerosol-generating substrate comprises a tobacco material that is combusted to form smoke. Therefore, in any of the embodiments described above, the aerosol-generating substrate may comprise a tobacco rod.

Alternatively, aerosol-generating articles according to the present invention may be articles in which a tobacco material is heated to form an aerosol, rather than combusted. In one type of heated aerosol-generating article, a tobacco material is heated by one or more electrical heating elements to produce an aerosol. In another type of heated aerosol-generating article, an aerosol is produced by the transfer of heat from a combustible or chemical heat source to a physically separate tobacco material, which may be located within, around or downstream of the heat source. The present invention further encompasses aerosol-generating articles in which a nicotine-containing aerosol is generated from a tobacco material, tobacco extract, or other nicotine source, without combustion, and in some cases without heating, for example through a chemical reaction.

BRIEF DESCRIPTION OF THE DRAWINGS

The invention will now be further described, by way of example only, with reference to the accompanying drawings in which.

DETAILED DESCRIPTION

Figure 1:
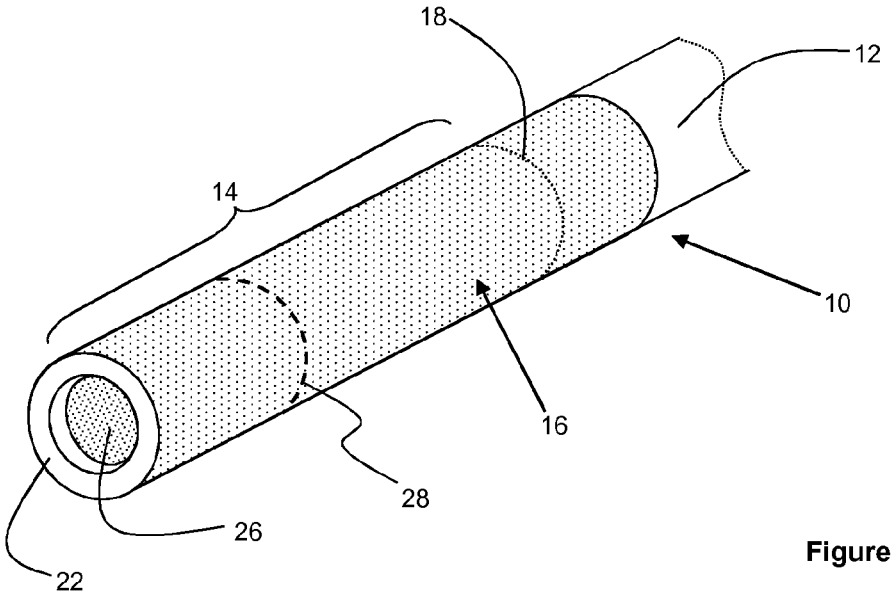
FIG. 1 shows a perspective view of an aerosol-generating article in accordance with a first embodiment of the present invention.

FIG. 1 shows an aerosol-generating article 10 in accordance with a first embodiment of the present invention. The aerosol-generating article 10 is a smoking article comprising an aerosol-generating substrate 12 in the form of a wrapped tobacco rod, and a mouthpiece 14 attached to the tobacco rod by a tipping wrapper 16 extending across the point of contact 18 between the downstream end of the tobacco rod and the upstream end of the mouthpiece 14.

Figure 2:
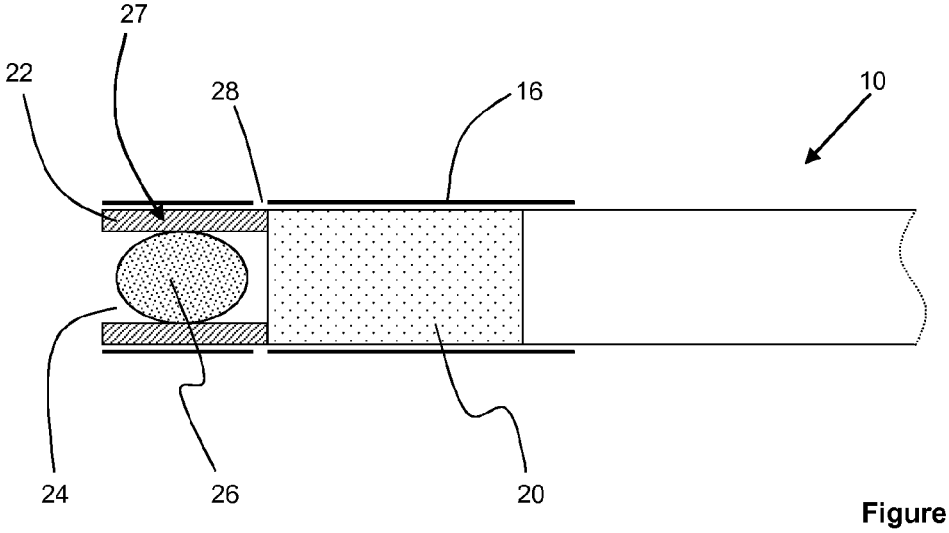
FIG. 2 shows a longitudinal cross-sectional view of the aerosol-generating article of FIG. 1.

As shown more clearly in FIG. 2, the mouthpiece 14 comprises an upstream segment of porous filter material 20 and a downstream segment of support material 22. The segment of support material 22 has an annular shape defining a channel 24 extending through the segment of support material 22 between its upstream and downstream ends. Contained within the channel 24 is a freshener delivery element 26 comprising a breakable capsule containing a liquid menthol flavourant. The segment of support material 22 in combination with the freshener deliver element 26 forms a blocking segment 27 that impedes the flow of air through the aerosol-generating article 10.

The tipping wrapper 16 comprises a line of weakness 28 extending around the full circumference of the tipping wrapper 16 and overlying the upstream edge of the segment of support material 22. The line of weakness 28 comprises a line of micro laser perforations.

Figure 3:
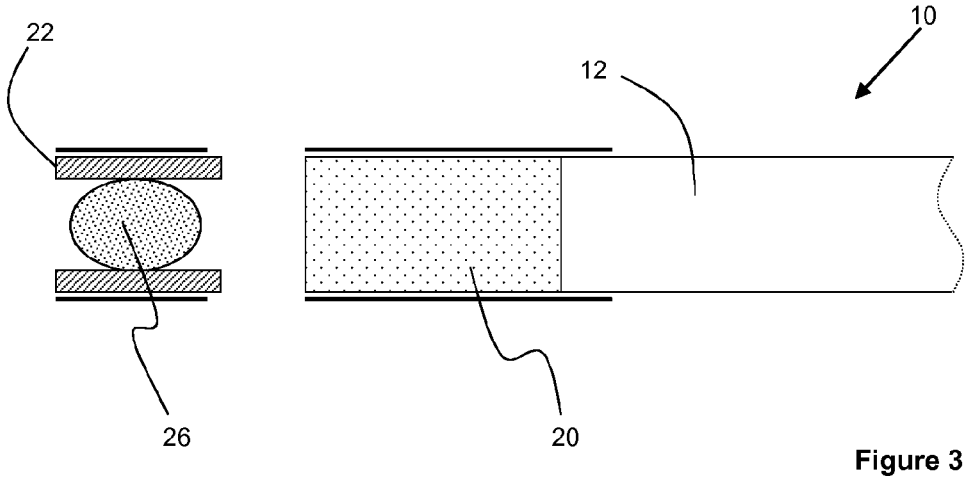
FIG. 3 shows a longitudinal cross-sectional view of the aerosol-generating article of FIG. 2 after the blocking segment has been detached.

With the blocking segment 27 attached to the aerosol-generating article 10 the aerosol-generating article 10 has a very high resistance to draw when a consumer attempts to draw on the downstream end of the smoking article. To smoke the smoking article a consumer pulls or twists the blocking segment 27 relative to the segment of porous filter material 20 to break the tipping wrapper 16 along the line of weakness 28, as shown in FIG. 3. The consumer can then smoke the smoking article comprising the tobacco rod and the segment of porous filter material 20 in the same manner as a conventional filter cigarette. After smoking the smoking article, the consumer can squeeze the freshener delivery element 26 along the channel 24 and out of the segment of support material 22 and consume the liquid menthol flavourant contained within the breakable capsule.

Figure 4:
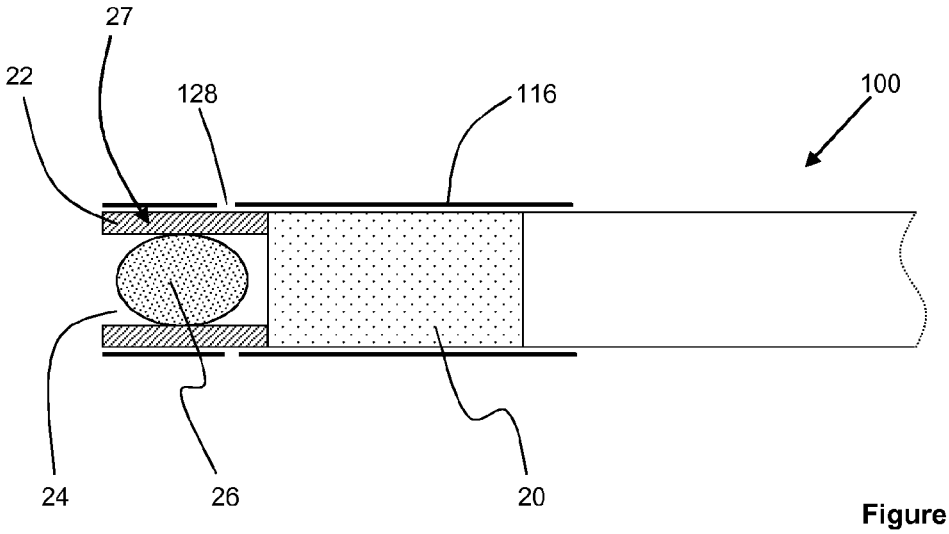
FIG. 4 shows a longitudinal cross-sectional view of an aerosol-generating article in accordance with a second embodiment of the present invention.
Figure 5:
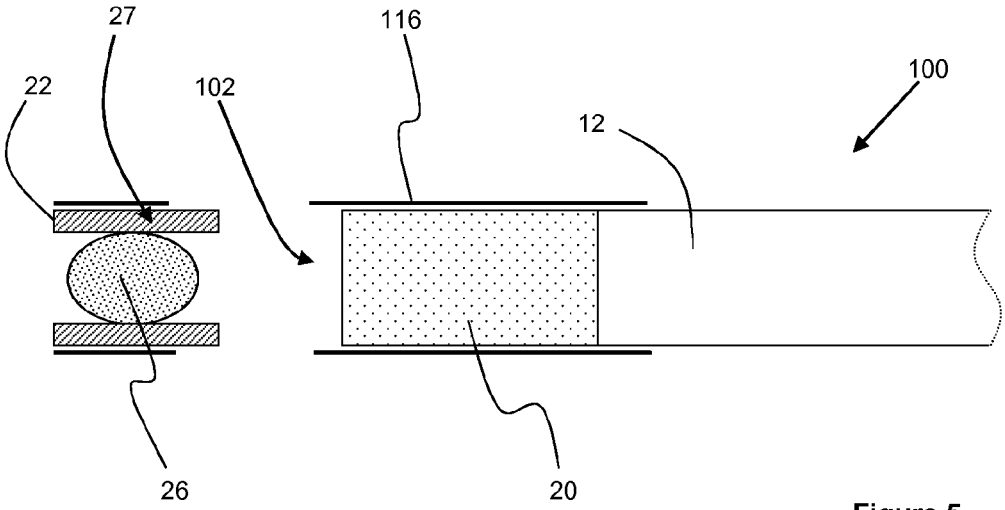
FIG. 5 shows a longitudinal cross-sectional view of the aerosol-generating article of FIG. 4 after the blocking segment has been detached.

FIGS. 4 and 5 show an aerosol-generating article 100 in accordance with a second embodiment of the present invention. The aerosol-generating article 100 shown in FIGS. 4 and 5 is substantially the same as the aerosol-generating article 10 shown in FIGS. 1 to 3, and like reference numerals are used to refer to like parts.

The difference in the aerosol-generating article 100 in accordance with the second embodiment of the present invention is the tipping wrapper 116, which comprises a line of weakness 128 positioned further downstream when compared to the line of weakness 28 on the aerosol-generating article 10 according to the first embodiment of the present invention. Although the detachment of the blocking segment 27 along the line of weakness 128 functions in the same way, the position of the line of weakness 128 further downstream is such that the portion of the tipping wrapper 116 that remains attached to the segment of filter material 20 extends downstream of the downstream edge of the segment of porous filter material 20 and therefore forms a mouth end recess 102 at the mouth end of the aerosol-generating article 100, as shown in FIG. 5.

The embodiments and examples shown in FIGS. 1 to 5 and described above illustrate but do not limit the invention. Other embodiments of the invention may be made without departing from the scope thereof, and it is to be understood that the specific embodiments described herein are not limiting.

The invention claimed is:

1. An aerosol-generating article comprising an aerosol-generating substrate and a mouthpiece secured to a downstream end of the aerosol-generating substrate, the mouthpiece comprising:

at least one segment of porous filter material; and a blocking segment downstream of the at least one segment of porous filter material, the blocking segment comprising a segment of support material having an annular shape defining a channel extending through at least part of the segment of support material between an upstream end of the segment of support material and a downstream end of the segment of support material, and at least one freshener delivery element contained within the channel extending through at least part of the segment of support material;

wherein the blocking segment comprising the at least one freshener delivery element is detachable from the at least one segment of porous filter material to decrease the resistance to draw of the aerosol-generating article.

2. An aerosol-generating article according to claim 1, wherein the aerosol-generating article has a resistance to draw of at least 250 millimeters of water gauge when the blocking segment is attached to the at least one segment of porous filter material.

3. An aerosol-generating article according to claim 1, wherein the aerosol-generating article has a resistance to draw of between 40 millimeters of water gauge and 150 millimeters of water gauge after the blocking segment has been detached from the at least one segment of porous filter material.

4. An aerosol-generating article according to claim 1, further comprising a wrapper circumscribing the mouthpiece and a portion of the downstream end of the aerosol-generating substrate, the wrapper comprising a line of weakness extending around the wrapper so that the blocking segment is detachable from the at least one segment of porous filter material by breaking the wrapper along the line of weakness.

5. An aerosol-generating article according to claim 4, wherein the line of weakness overlies an upstream edge of the blocking segment.

6. An aerosol-generating article according to claim 4, wherein the line of weakness overlies the blocking segment downstream of an upstream edge of the blocking segment, and wherein a portion of the wrapper upstream of the line of weakness extends downstream of a downstream edge of the at least one segment of porous filter material so that the portion of the wrapper upstream of the line of weakness defines a mouth end recess when the blocking segment has been detached.

7. An aerosol-generating article according to claim 6, wherein the wrapper is a tipping paper having a basis weight of between 65 grams per square meter and 85 grams per square meter.

8. An aerosol-generating article according to claim 1, wherein each of the channel and the freshener delivery element has a substantially circular cross-sectional shape, and wherein an internal diameter of the channel is less than an external diameter of the freshener delivery element.

9. An aerosol-generating article according to claim 1, wherein the at least one freshener delivery element comprises at least one solid freshener delivery element.

10. An aerosol-generating article according to claim 1, wherein the at least one freshener delivery element comprises at least one breakable capsule containing a gel or liquid freshener.

11. An aerosol-generating article according to claim 1, wherein the at least one freshener delivery element comprises a flavourant comprising at least one of menthol, linalool, thymol, eucalyptol, methyl salicylate, and combinations thereof.

12. An aerosol-generating article according to claim 1 wherein the channel of the segment of support material is open only at one end of the segment of support material.

13. An aerosol-generating article according to claim 1, wherein the aerosol-generating substrate comprises a tobacco rod.

* * * * *